United States Patent [19]

Iida et al.

[11] Patent Number: 4,605,091

[45] Date of Patent: Aug. 12, 1986

[54] SOUND INSULATING APPARATUS

[75] Inventors: Kazuyoshi Iida; Keiichiro Mizuno, both of Yokohama; Michiyuki Yamaguchi, Fuchu; Kazuo Kondo, Yokohama, all of Japan

[73] Assignee: Bridgestone Corporation, Tokyo, Japan

[21] Appl. No.: 742,508

[22] Filed: Jun. 7, 1985

[30] Foreign Application Priority Data

Jun. 21, 1984 [JP] Japan ..... 59-126506

[51] Int. Cl.[4] ..... E04F 17/04

[52] U.S. Cl. ..... 181/224; 181/256

[58] Field of Search ..... 181/224, 256

[56] References Cited

U.S. PATENT DOCUMENTS 1,964,845 7/1934 Dietze et al. ..... 181/224 X 4,418,788 12/1963 Gorchev et al. ..... 181/224

4,432,434 2/1984 Dean, Jr. ..... 181/224 X

*Primary Examiner*—Benjamin R. Fuller

*Attorney, Agent, or Firm*—Armstrong, Nikaido, Marmelstein & Kubovcik

[57] ABSTRACT

A sound insulating apparatus. Heretofore, the sound insulating apparatus to be installed in a ventilator, etc. of an architecture requires a long duct, and becomes large in its size and heavy in its weight, and is not sufficient in its sound absorbing performance.

The sound insulating apparatus according to the present invention comprises a closed container including a first opening and a second opening, and having a sound absorbing member at its internal surface. The first opening is provided with a sound converging means for converging a sound wave coming into the closed container through the first opening to a predetermined place within the closed container. The second opening is formed in a place away from the predetermined place.

This sound insulating apparatus is installed in a communicating port for intercommunicating two spaces partitioned with respect to each other, such as, for example, a ventilator of an architecture, with the first opening facing toward one space and the second opening facing toward the other space.

7 Claims, 9 Drawing Figures

SOUND INSULATING APPARATUS

BACKGROUND OF THE INVENTION

This invention relates to a sound insulating apparatus to be installed in a communicating port for communicating two spaces partitioned with respect to each other and adapted to diminish a sound propagating from one space to the other through the communicating port.

The sound insulating apparatus according to the present invention is installed in a ventilator of various architectures such as, for example, a house, shop, office, workshop, etc., in order to prevent an outside noise to come into the architecture through the ventilator, or an inside noise to come out of the architecture through the ventilator, but to allow air to pass freely therethrough.

As a gimmick to pass only air and insulate a sound as mentioned above, heretofore, there has been widely practiced as follow. That is, a sound absorbing material such as a glass wool is attached to the internal side of a duct. However, in such a conventional sound insulating apparatus as mentioned, a sound which advances straight forward along the elongated direction of the duct is absorbed by a sound absorbing material disposed parallel thereto. Therefore, it was difficult to obtain a sufficient effect of sound insulation.

Also, there are others which attempt to damp a sound by bending the duct at right angles, or by providing a sound absorbing chamber in the duct so that the sound will be damped by means of enlarging or reducing its passage. However, they were effective only for a noise of particularly limited frequency range, and no sufficient muffling effect could be expected for a noise of wide frequency band width.

Furthermore, all of the above mentioned conventional sound absorbing apparatuses had such disadvantages as that the passage resistance is increased due to the long duct, and that the weight is increased due to the large external dimension thereof.

SUMMARY OF THE INVENTION

It is therefore a general object of the present invention to provide a sound insulating apparatus installed in an air passage and adapted to insulate a sound propagating along the air passage.

A specific object of the present invention is to provide a sound insulating apparatus which can render a large insulating effect of a sound.

Another specific object of the present invention is to provide a sound insulating apparatus wherein no long duct is required and therefore compact in its size.

A further specific object of the present invention is to provide a sound insulating apparatus which is installed in a ventilator of an architecture and adapted to prevent a sound to come out of the architecture through the ventilator.

A still further specific object of the present invention is to provide a sound insulating apparatus which is installed in the ventilator of the architecture and adapted to prevent a sound to come into the architecture from outside through the ventilator.

In order to achieve the above objects, there is essentially provided a sound insulating apparatus comprising a closed container including first and second openings and provided at its internal surface with a sound absorbing member. The first opening is provided with sound converging means for converging a sound wave coming in the closed container through the first opening to a predetermined place in the closed container. The second opening is formed in a place away from the predetermined place. And, this sound insulating apparatus is installed in a communicating port for intercommunicating two spaces partitioned with respect to each other, with the first opening facing toward the one space and the second opening facing toward the other space.

Most of the sound waves arrived at the first opening from the one space are converged to the predetermined place within the closed container by the sound converging means and absorbed by the sound absorbing member there. Therefore, the level of a sound to be leaked into the other space through the second opening formed in a place away from the predetermined place becomes extremely low. The sound converging means renders such an effect as similar to the one which an optical lens renders to an optical wave, to the sound wave in order to refract the progressing direction of the sound wave, so that the sound wave will be converged to the predetermined place. Because of the foregoing construction, the closed container will suffice, even if it is made small in its size.

DETAILED DESCRIPTION OF THE EMBODIMENTS

Figure 1:
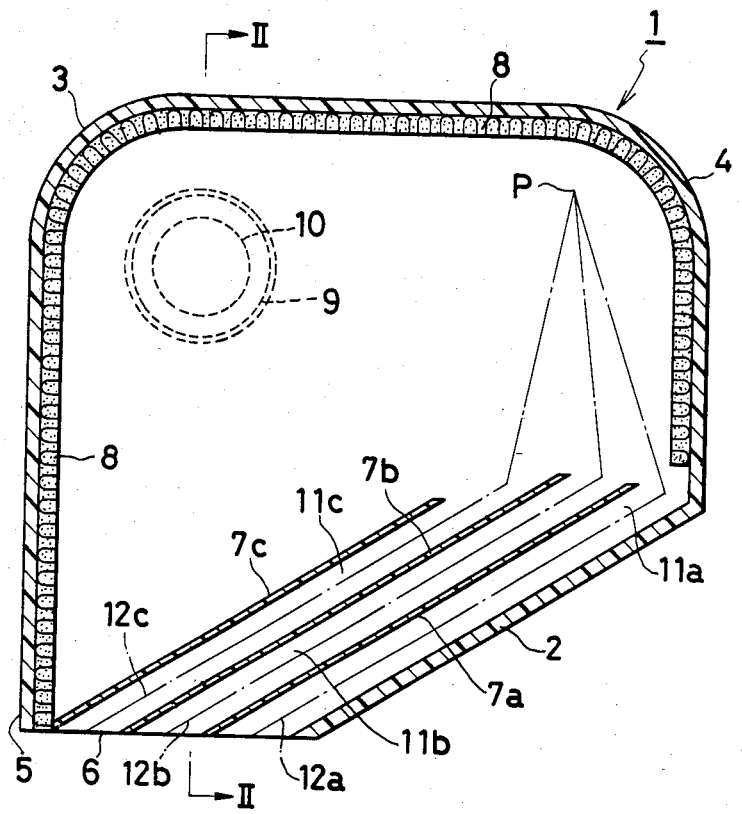
FIG. 1 is a cross sectional front view showing one embodiment of the present invention.
Figure 2:
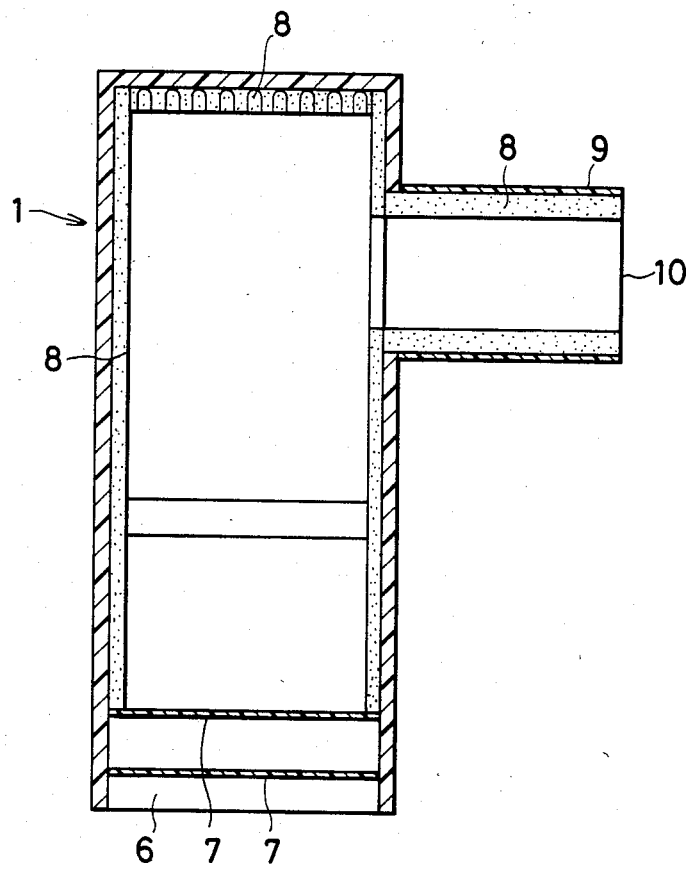
FIG. 2 is a sectional view taken on line II—II of FIG. 1.
Figure 3:
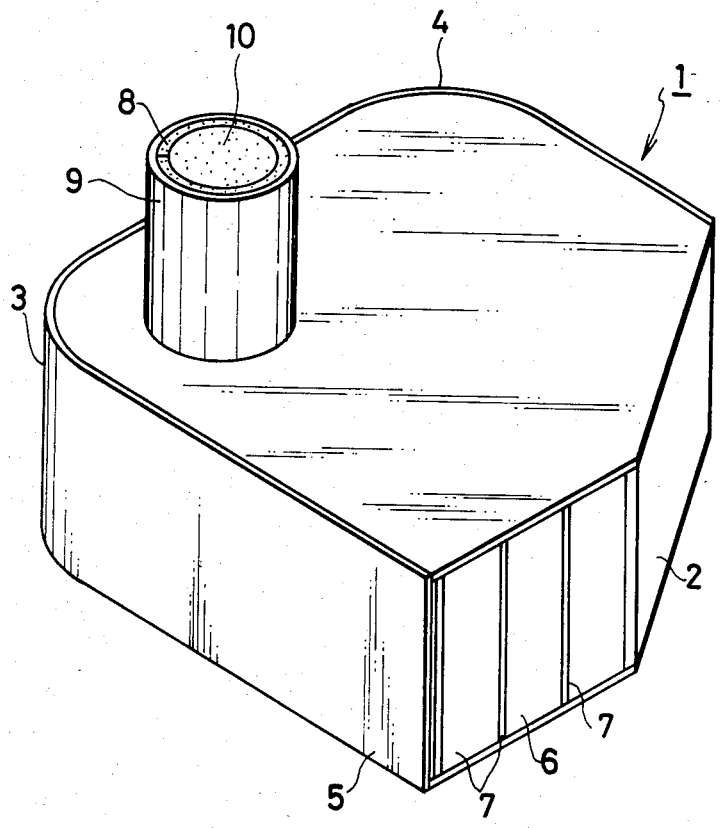
FIG.3 is a perspective view of its appearance.

Preferred embodiments of the present invention will be described hereunder with reference to the accompanying drawings.

FIGS. 1 through 4 illustrate a first embodiment of the present invention. 1 denotes a closed container. This container 1 comprises a hollow, flat rectangular body made of a plastic plate, with its one corner cut out at an angle, and a slant plate 2 adapted to block the cut out portion, a corner portion 3 located in a diagonal position opposite to the cut out portion and another corner portion 4 positioned between this corner portion 3 and the cut out portion being curved at ¼ cylindrical surface shape, an opening 6 being formed between the remaining corner 5 and the slant plate 2.

A number of partition plates 7 parallel to the slant plate 2 are arranged at predetermined spaces from the opening 6 toward the interior part of the closed container 1. The closed container 1 is attached at its internal surface with a soft elastic sound absorbing member 8 such as a foam urethane.

Further, the closed container 1 is connected at its side wall adjacent to the corner portion 3 with one end of a circular tube 9. The elastic sound absorbing member 8 is also attached to the internal surface of the circular tube 9. An external end portion 10 of the circular tube 9 is opened up.

The lengths of the respective partition plates *7a*, *7b*, *7c* . . . are selected as such that regarding an optional passage 11 partitioned by these partition plates, the sum of the length of the passage 11 and the distance from one end portion of this passage to a predetermined position P at the inside of the closed container 1 will become constant.

The configurations of end surfaces (enveloping surfaces) formed by the internal ends of the respective partition plates *7a, 7b, 7c* . . . having the lengths determined as described are of a lens shape. The sounds passing through the respective passages 11*a*, 11*b*, 11*c* . . . are converged to the point P according to Huygens' principle.

The lengths of the respective partition plates 7 can be determined in such a manner as will be described hereunder, for example, with reference to FIG. 4.

First of all, the position P away from a mounting position of the circular tube 9 is determined at the inside of the closed container 1. Then, a center line 12*a* of the passage 11*a* held between the partition plate *7a* proximate to the slant plate 2 and the slant plate 2 itself is extended from a foremost end Qa of the passage and a point Ra is obtained on the center line 12*a* that satisfies the following relation.

$$\overline{PQa}=\overline{QaRa}$$

Then, a line X parallel to the opening 6 is drawn from the point Ra. The points at which the center lines 12*b*, 12*c*, 12*d* . . . of the respective passages 11*b*, 11*c*, 11*d* . . . and the line X intersect are set to be Rb, Rc, Rd . . . .

And, the points at which the vertical bisectors Sb, Sc, Sd . . . of the lines connecting P and Rb, Rc, Rd . . . intersect the central lines 12*b*, 12*c*, 12*d* . . . are set to be Qb, Qc, Qd . . . . Thereafter, the lengths of the respective partition plates *7a, 7b, 7c* . . . are set as such that the ends of the partition plates *7a, 7b, 7c* . . . will be positioned on the line W connecting these intersecting points Qa, Qb, Qc . . . .In this way, the configurations of the end surfaces are obtained. Since the embodiment illustrated in FIGS. 1 through 4 is constructed as mentioned above, when the opening 6 of the closed container 1 is faced toward a sound source (not shown) in a room and the external end portion 10 of the circular tube 9 is opened up at outside of the room, air in the room can be exchanged since the inside and outside of the room are communicated with each other through the closed container 1 and the circular tube 9.

Also, when a noise within the room arrives at the opening 6 of the closed container 1, the noise passes through the passages 11*a*, 11*b*, 11*c* . . . , arrives at the space within the closed container 1, is refracted at the end portions Qa, Qb, Qc . . . of the passages 11*a*, 11*b*, 11*c* . . . by Huygens' principle, and is converged to the point P.

The reason of the above is that the respective sums of the respective lengths of the passages 11*a*, 11*b*, 11*c*, . . . and the respective distances Qap, Qbp, Qcp . . . from the end portions Qa, Qb, Qc . . . to the point P become constant.

Since the point P where the noise is concentrated is positioned away from the circular tube 9, and in addition, the elastic sound absorbing member 8 is attached to the internal surfaces of the closed container 1 and the circular tube 9, the noise is hardly propagated to outside of the room through the opening 10 of the circular tube 9.

Figure 5:
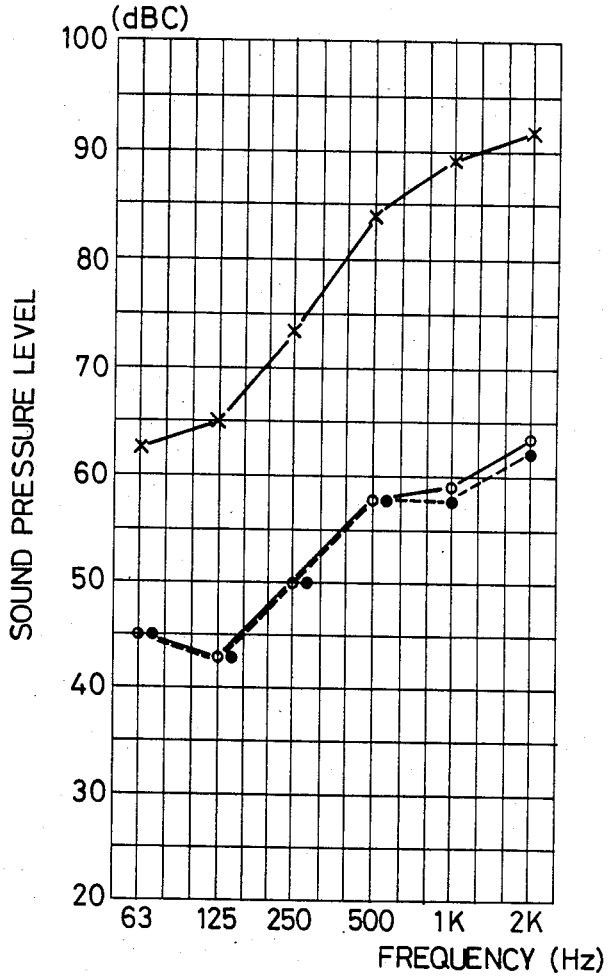
FIG. 5 is a graph showing a test result of the above embodiment.

A result of measurement obtained by test for proving the above is shown in FIG. 5. As seen in FIG. 5, there is no substantial difference between a sound pressure level (the line connecting marks ● ) at a time when the external end portion 10 of the circular tube 9 is blocked, and a sound pressure level (the line connecting marks ○) at a time when the circular tube 9 is opened as in the case with this embodiment. The sound pressure level is extensively reduced when compared with a sound pressure level (the line connecting marks x) at the opening 6 of the closed container 1. In the present invention, since the sound is insulated without using the interference phenomenon, a sufficient sound insulating effect can be expected in a wide frequency band. The respective partition plates 7 and the slant plate 2 may be attached with a sound absorbing member similar to the sound absorbing member 8.

Figure 4:
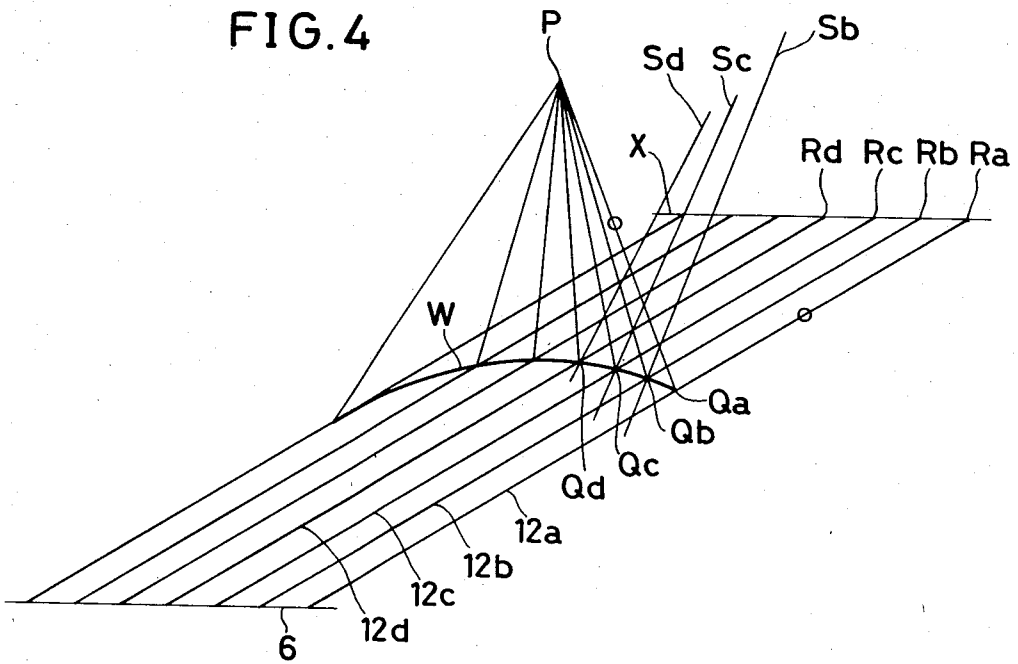
FIG. 4 is a schematic view for explaining sound converging means used in the above embodiment.

In the embodiment as shown in FIGS. 1 through 4, the slit shaped passage 11 is formed by the partition plate 7 parallel to the slant plate 2. Alternatively, as shown in FIG. 6, a screen board 13 parallel to the slant plate 2 may be set up from the end portion of the opening 6 adjacent to the corner portion 5 toward the internal part of the closed container 1, a sound wave delaying member 14 made of a ceramic foam material may be filled in between the slant plate 2 and the screen board 13, and the internal end surface of the sound wave delaying member 14 may be formed in a lens shape as in the same manner as shown in FIG. 4.

Figure 6:
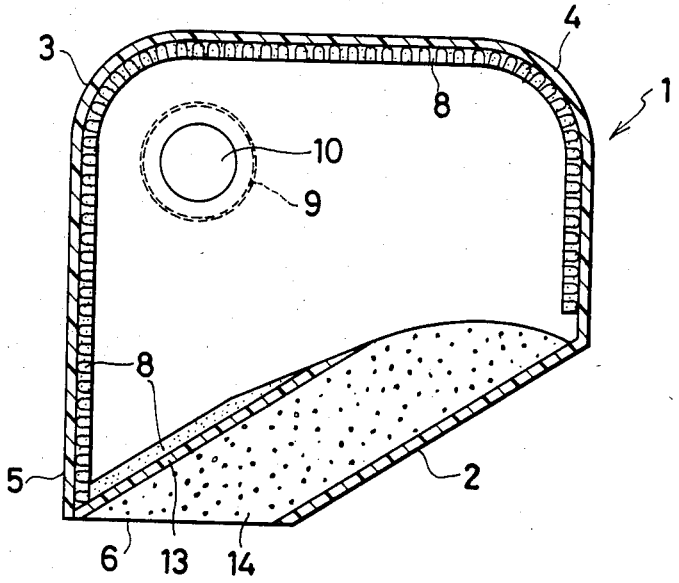
FIGS. 6 through 9 are cross sectional views respectively showing other embodiments of the present invention.

Another embodiment illustrated in FIG. 6 apparently renders the similar technical effects as those of the embodiment illustrated in FIGS. 1 through 4.

In the embodiment illustrated in FIG. 6, the ceramic foam material is used as the sound wave delaying member 14. Alternatively, other materials such as metallic foam, metallic fiber, metallic particle, ceramic particle, resin hardened foam having less remaining membrane, etc. may be employed.

Figure 7:
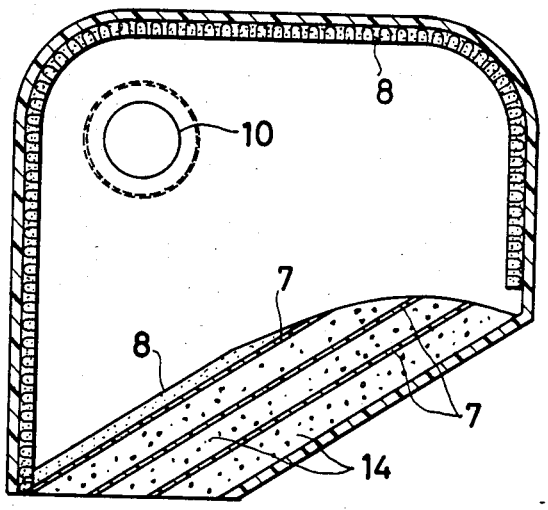

Similarly, the slit shaped passage 12 of the first embodiment shown in FIGS. 1 through 4 may be filled with the sound wave delaying member 14 as shown in FIG. 7.

Figure 8:
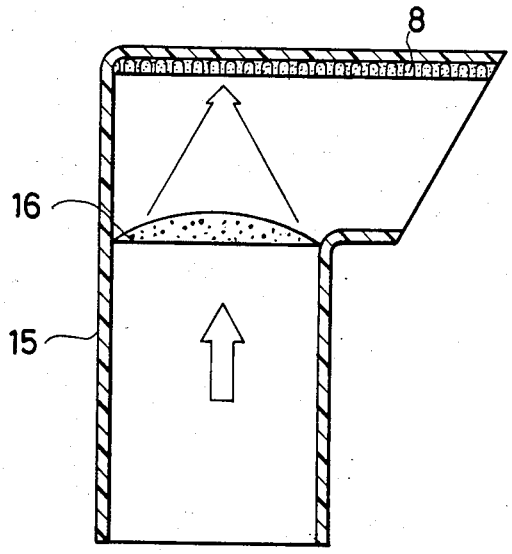

Similarly, as shown in FIG. 8, a sound delaying member 16 formed in a convex lens shape may be provided at a curved portion of a circular tube shaped container 15 bent in a letter "L" shape and the sound absorbing member 8 may be provided opposite to the sound wave delaying member 16. The sound converged by this sound wave delaying member 16 is absorbed by the sound absorbing member 8.

Figure 9:
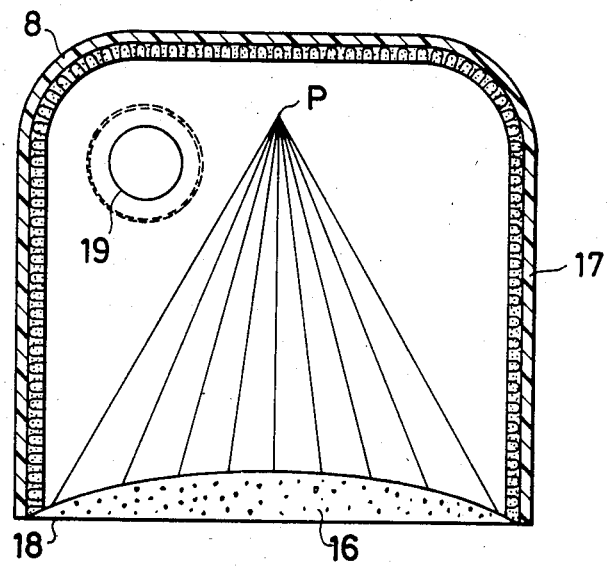

Similarly, as shown in FIG. 9, the lens shaped sound delaying member 16 is provided at an opening portion 18 of a closed container 17 of a hollow flat body shape. A circular tube 19 is mounted at a place away from a converging point P.

Of course, it is possible to provide a forced ventilation fan driven by a motor at the inside of the aforementioned closed containers 1, 15 and 17. Also, the sound insulating apparatus according to the present inventon may be applied not only to a ventilator but also to, for example, an exhaust port for discharging gas other than air, or air mixed gas, etc.

What is claimed is:

1. A sound insulating apparatus for installation in a communicating means interconnecting a first space and a second space otherwise separated from one another by partition means, for reducing sound propagation through said communicating means between said first and second spaces while allowing air and gas exchange therebetween, comprising:

closed hollow container means having an outer wall for enclosing an interior thereof, said outer having an interior surface defining said interior therewithin;

a first opening in said container means for communicating said interior thereof with said first space;

sound converging means provided at said first opening in said container means for converging sound waves entering said first opening from said first space towards a predetermined convergence point within said interior of said container means;

a sound absorbing member attached to said interior surface at least at said predetermined convergence point for absorbing said converged sound waves; and a second opening in said container means for communicating said interior thereof with said second space, said second opening being positioned away from said predetermined convergence point.

2. A sound insulating apparatus in accordance with claim 1, wherein said sound converging means comprises a plurality of partition plates extending parallel to one another towards the interior of said container means from said first opening so as to define a plurality of parallel passages each defined by a pair of parallel walls, end surfaces of said plurality of partition plates within said container interior forming a converging lens shape.

3. A sound insulating apparatus in accordance with claim 2, wherein said parallel passages are filled with a sound wave delaying material.

4. A sound insulating apparatus in accordance with claim 1, wherein said sound converging means comprises a sound wave delaying member extending within the interior of said closed container from said first opening, an end surface of said sound delaying member within said interior being formed in a converging lens shape.

5. A sound insulating apparatus in accordance with claim 1, wherein said communicating means is a ventilator of a building structure.

6. A sound insulating apparatus in accordance with claim 1, wherein said first space is a room interior of a building structure and said second space is external of said building structure.

7. A sound insulating apparatus in accordance with claim 1, wherein said second space is a room interior of a building structure and said first space is external of said building structure.

* * * * *